US012774149B2

(12) United States Patent
Eickhoff et al.

(10) Patent No.: US 12,774,149 B2
(45) **Date of Patent: *Oct. 27, 2026**

(54) STACKABLE CONTAINER, A STACKABLE CONTAINER PACKAGE, AND A METHOD OF USE OF THE SAME

(71) Applicant: BERRY GLOBAL, INC., Evansville, IN (US)

(72) Inventors: Jonathan Eickhoff, Evansville, IN (US); Braxton J. Bragg, Evansville, IN (US); David C. Arnold, Evansville, IN (US)

(73) Assignee: BERRY GLOBAL, INC., Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/976,732

(22) Filed: Dec. 11, 2024

(65) Prior Publication Data

US 2025/0100779 A1 Mar. 27, 2025

Related U.S. Application Data

(63) Continuation of application No. 17/946,570, filed on Sep. 16, 2022, now Pat. No. 12,187,526.

(60) Provisional application No. 63/245,406, filed on Sep. 17, 2021.

(51) Int. Cl.

| | |
|---|---|
| ***B65D 83/08*** | (2006.01) |
| ***B65D 21/02*** | (2006.01) |
| ***B65D 47/08*** | (2006.01) |

(52) U.S. Cl.

CPC ..... *B65D 83/0805* (2013.01); *B65D 21/023* (2013.01); *B65D 47/0804* (2013.01)

(58) Field of Classification Search

CPC ..... A47K 10/42; B65D 21/02; B65D 43/02; B65D 47/08; B65D 47/0804; B65D 71/00; B65D 71/40; B65D 83/08; B65D 83/0805; B65D 85/62; B65D 21/023

USPC ..... 206/386, 494, 595–600

See application file for complete search history.

(56) References Cited

U.S. PATENT DOCUMENTS

| | | | | |
|---|---|---|---|---|
| 2,335,914 | A * | 12/1943 | Buttery | B65D 71/40 206/499 |
| 2,672,981 | A * | 3/1954 | Colgren | B65D 85/62 206/499 |
| 3,669,305 | A | 6/1972 | Kinney | |
| 3,672,536 | A | 6/1972 | Kinney | |
| 3,780,908 | A * | 12/1973 | Fitzpatrick | A47K 10/421 221/48 |
| 7,169,418 | B2 * | 1/2007 | Dalton | B65D 51/165 220/366.1 |
| 7,992,745 | B2 * | 8/2011 | Sellars | A47K 10/3818 221/33 |
| 9,974,419 | B2 | 5/2018 | Azelton | |
| 9,986,875 | B2 * | 6/2018 | Mehdizadeh | B65D 47/0871 |
| 10,039,425 | B2 | 8/2018 | Azelton | |
| 11,192,697 | B2 | 12/2021 | Kouba | |
| 2013/0213841 | A1 * | 8/2013 | Ward | B65D 21/0201 206/509 |

(Continued)

*Primary Examiner* — Bryon P Gehman

(74) *Attorney, Agent, or Firm* — Barnes & Thornburg LLP

(57) ABSTRACT

A container has a side wall thickness profile sufficient for withstanding loads such as a top load, a package including the container and a lid, and methods and systems related to the container, are disclosed.

19 Claims, 9 Drawing Sheets

(56) References Cited

U.S. PATENT DOCUMENTS

2017/0129648 A1* 5/2017 Young ..... B65D 21/0233
2019/0322406 A1* 10/2019 Makarchuk ..... B65D 1/26

* cited by examiner

STACKABLE CONTAINER, A STACKABLE CONTAINER PACKAGE, AND A METHOD OF USE OF THE SAME

PRIORITY CLAIM

This application is a Continuation of U.S. patent application Ser. No. 17/946,570, filed Sep. 16, 2022, which claims priority under 35 U.S.C. § 119(e) to U.S. Provisional Application Ser. No. 63/245,406, filed Sep. 17, 2021, each of which is expressly incorporated by reference herein.

BACKGROUND

The present disclosure relates generally to a container, and more specifically to a stackable container, and methods of use.

SUMMARY

According to the present disclosure, a container that has a side wall thickness profile that is enhanced for efficiency. Material reduced at various locations to reduce material weight and the container is sufficiently structurally rigid to carry a pre-determined top load.

In illustrative embodiments, a wipes dispensing container is provided that is configured to receive a wipes dispensing lid. The container includes a side wall and a bottom that cooperate to form a product storage region. The container includes a brim located at a top end of the container and defines an opening into the product storage region, and a shoulder disposed between the brim and the side wall. The brim has an outer diameter that is larger than a bottom diameter. The side wall has an upper area, a lower area, and a central area disposed between the upper area and the lower area in a vertical direction.

In illustrative embodiments, the upper area has a thickness in the range of about 0.010 inches to about 0.030 inches, the central area has a thickness in the range of about 0.010 inches to about 0.030 inches, and the lower area has a thickness in the range of about 0.010 inches to about 0.030 inches. The container has a weight of about 37 grams or less.

In illustrative embodiments, a method of providing a package includes providing a sheet of material having a thickness of about 0.160 inches to about 0.200 inches, and thermoforming the sheet of material into a container having a depth in the range of about 6" to about 8". The container has a side wall and a shoulder, with the side wall being tapered and having a first angle such that the side wall is wider at the top than at the bottom, and with an angled shoulder having a second angle such that the shoulder is narrower at the top than at the bottom. The method includes combining a plurality of containers into a container stack, providing a plurality of container stacks into a rectangular array, and providing the rectangular array in a shipping container.

In illustrative embodiments, a shipping system for shipping a plurality of stackable containers includes a pallet having a plurality of layers, each layer including a plurality of shipping containers. Each shipping container of the plurality of shipping containers includes a rectangular array of container stacks. Each container stack includes at least 2 containers stacked together. Each container stack includes at least one upper container having a height that is inserted at least 50 percent into a lower container. Each container has a tapered side wall that is wider at the top than at the bottom. Each container includes a shoulder that is tapered radially inwardly as it extends from a shoulder bottom to a brim to provide a stacking shoulder having a shoulder height that is not inserted into a lower container when in the container stack. Each container has a weight of about 37 grams or less and each container has a top load rating of at least about 100 lbs.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

DETAILED DESCRIPTION

Embodiments now will be described more fully hereinafter with reference to the accompanying drawings, in which some, but not all embodiments are shown. Indeed, embodiments may take many different forms and the present disclosure should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
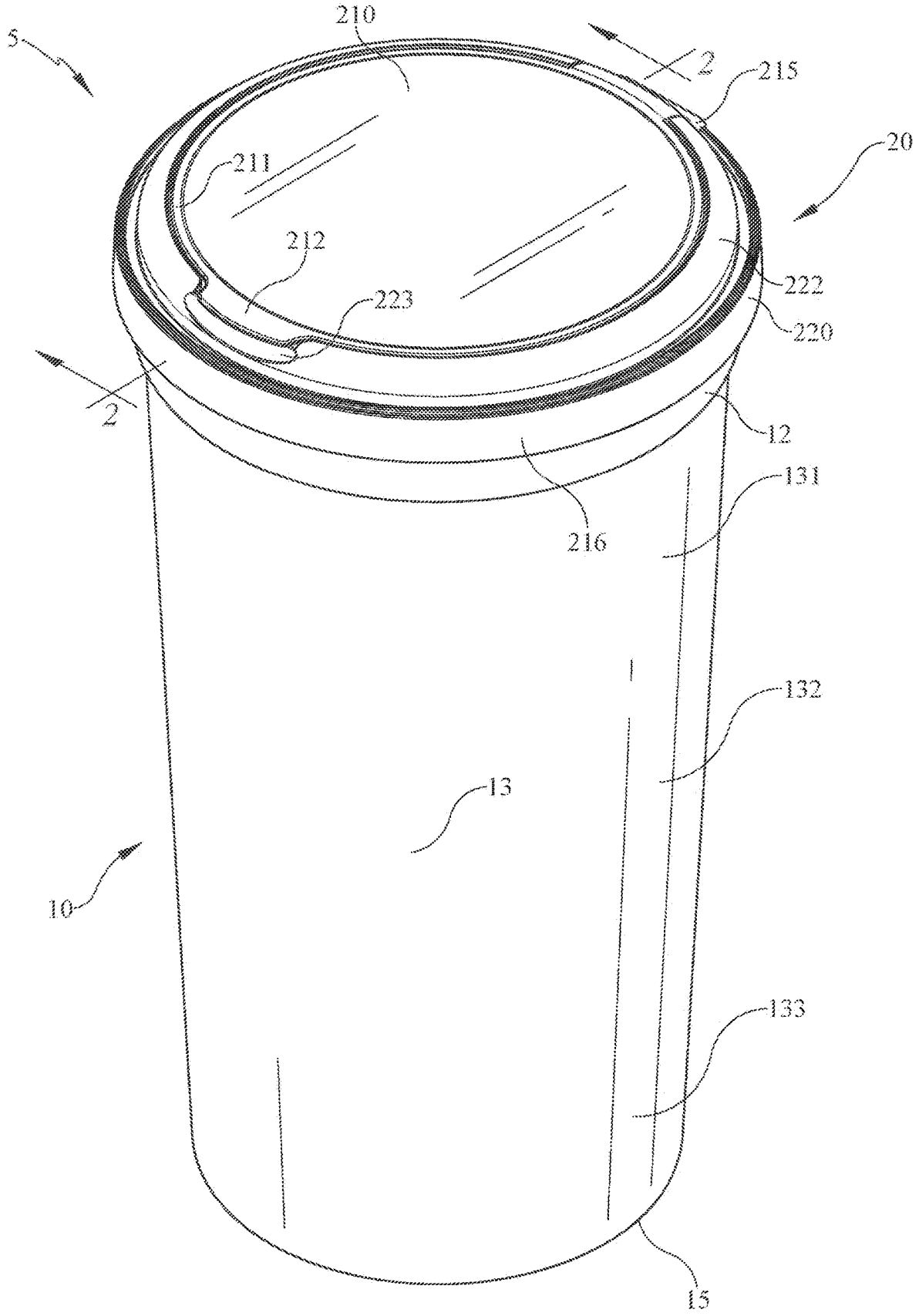
FIG. 1 is a perspective view showing an exemplary embodiment of a package having a container and a lid in a closed position.

Some embodiments of a package 5, such as the exemplary embodiment shown in FIG. 1, may include a container 10 and/or a lid 20. Container 10 may be configured to store product therein, and lid 20 may be configured to be movable between a closed position, as shown in FIG. 1, and an open position, as shown for example in FIG. 3. Lid 20 may include a cover portion 210 that may be movable relative to the rest of lid 20 and/or container 10, such as by rotating via a hinge 215. In the closed position shown in FIG. 1, a user may be blocked from accessing a product storage region 19 of container 10 (product storage region is shown for example in FIGS. 2 and 3). In the open position shown in FIG. 3, a user may be allowed to access product storage region 19 and/or any contents therein. As discussed more below, container 10 may be configured in such a way as to have a reduced weight and/or a reduced amount of material used to form it, while having a relatively high top load for its weight and/or be stackable. In this way, for example, a relatively high number of relatively light weight containers 10 may be stacked and/or shipped to reduce freight costs, fuel, and the like.

Figure 2:
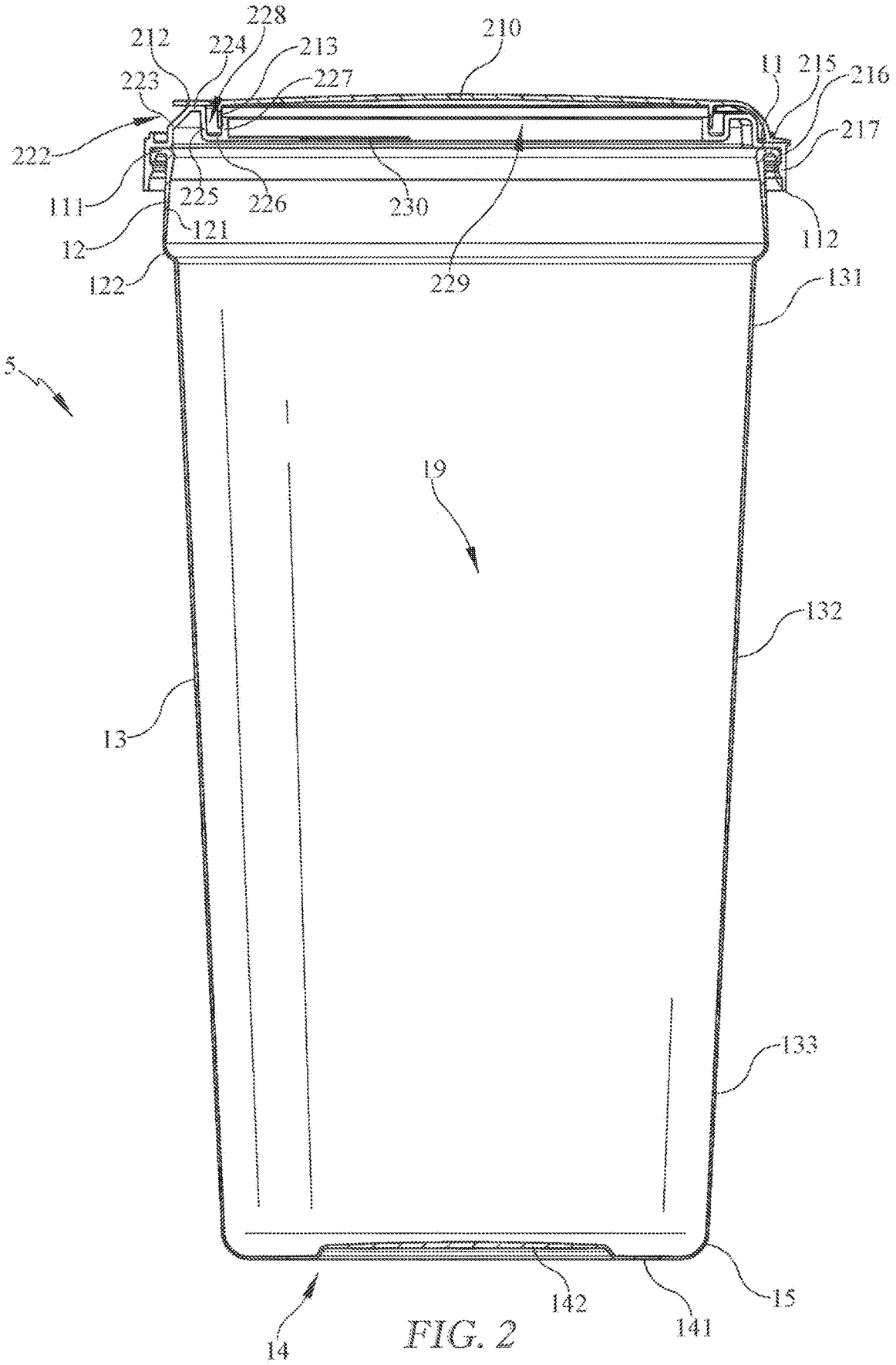
FIG. 2 is a sectional view taken along line 2-2 of FIG. 1.

Package 5 is shown in cross-section in FIG. 2 and illustrates features of container 10 and lid 20 in more detail. Container 10 may include a top portion or brim 11, a shoulder 12, a side wall 13, a bottom or floor 14, and/or a heel 15 any or all of which may cooperate to form product storage region 19. Brim 11 may extend radially outwardly from shoulder 12 to a brim outer edge 112. Brim 11 may include a brim top surface 111 configured to contact lid 20 or a portion thereof, for example, to support lid 20 in a vertical direction. Lid 20 may include a lower portion 220, a lower skirt 216, and/or a bead 217. Brim 11 and/or brim outer edge 112 may engage lower skirt 216 and/or bead 217 to form a snap fit or attachment mechanism between container 10 and lid 20. Shoulder 12 may extend downwardly and/or radially outwardly from brim 11 along a shoulder side wall 121 and/or to a shoulder bottom 122. As discussed more below, shoulder 12 may be configured such that shoulder bottom 122 may rest on and/or stack with brim 11 of another container 10 (see, e.g., FIG. 8). Shoulder bottom 122 may be disposed proximate side wall 13.

As discussed more below, side wall 13 may include an upper area 131, an intermediate area 132, and/or a lower area 133, as shown in FIG. 2 for example, any or all of which may have relative thicknesses and/or material distribution to facilitate a relatively light weight yet rigid design of container 10. Heel 15 may be interposed between side wall 13 and bottom 14 of container 10. Heel 15 may provide a curved, angled, and/or gradual transition between side wall 13 and bottom 14.

As shown in FIG. 2, floor or bottom 14 may include a step, such as provided by the different heights of bottom flat area 141 and bottom raised area 142. This step or other feature(s) may be included to add structural rigidity to container 10 and/or bottom 14 or for any other reason or combination of reasons. For similar reasons or for any other reason, container 10 may transition from side wall 13 to bottom 14 at heel 15. Heel 15 may be rounded or chamfered, for example, to reduce stress concentrations where side wall 13 meets bottom 14. In the embodiment shown in FIG. 2, heel 15 may have a radius of curvature of about 0.200".

Figure 3:
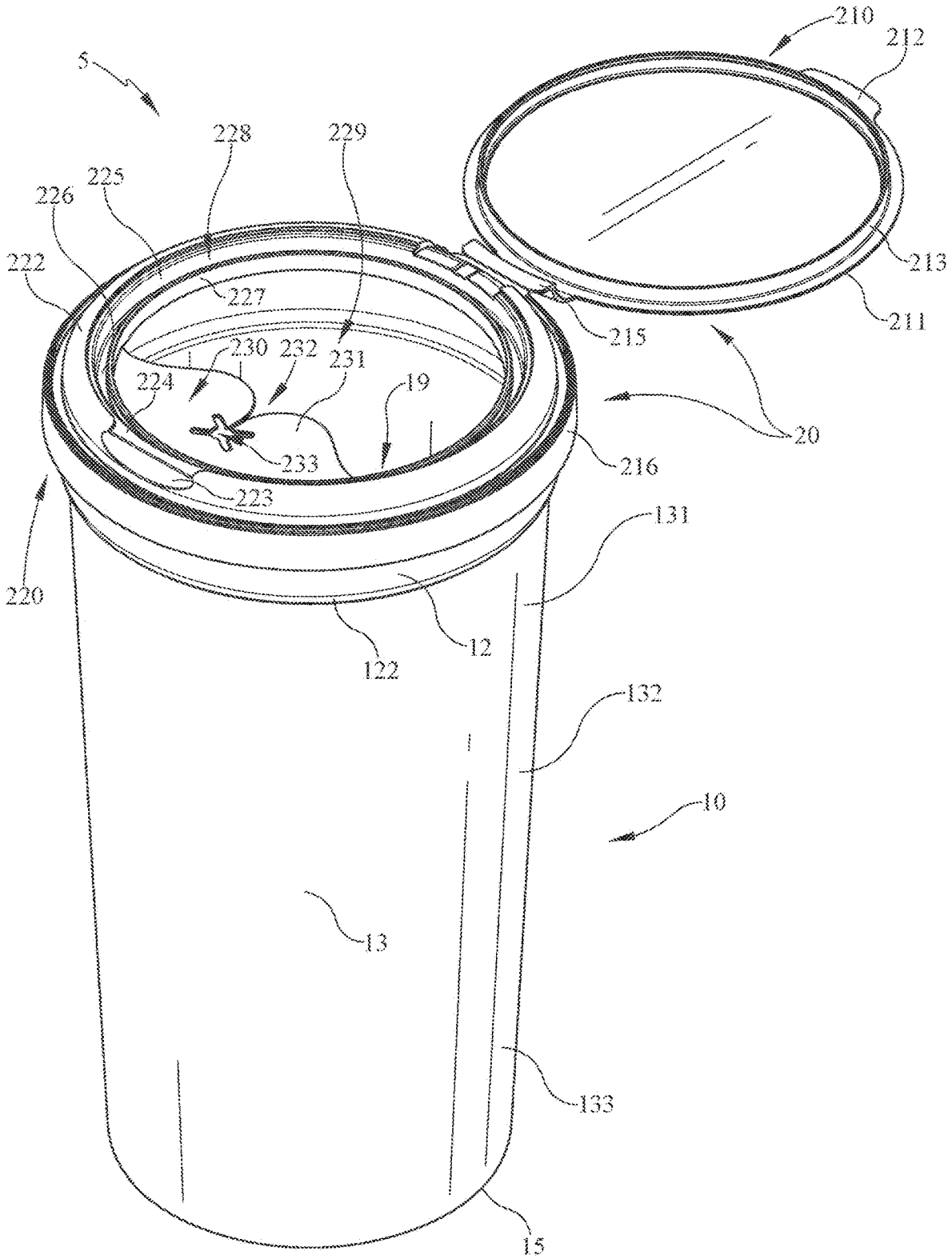
FIG. 3 is a view similar to FIG. 1 with the lid in an open position.

FIG. 3 illustrates package 5 in an open position, showing elements of lid 20 in more detail. Lid 20 may include an attachment portion 220. Covering portion 210 may move about hinge 215 relative to attachment portion 220 between a closed position and an open position. Covering portion 210 may include an outer perimeter 211, a finger tab 212, and/or an upper annular ring 213. Upper annular ring 213 may be configured to engage channel 228 of attachment portion 220 to securely close and/or seal covering portion 210 relative to attachment portion 220. Finger tab 212 may extend radially outwardly away from upper annular ring 213, for example, to provide a surface that a user may engage with a finger, thumb, or the like, to disengage covering portion 210 from attachment portion 220. Attachment portion 220 may include a landing 223 to facilitate a user opening covering portion 210 instead of or in addition to finger tab 212. Lower skirt 216 and/or bead 217 may be disposed radially outwardly on attachment portion 220 to engage brim 11. For example, lower skirt 216 may be disposed radially outwardly of an upper portion 222 of attachment portion 220. Upper portion 222 may include an upper surface 224 configured to contact, support, and/or engage an underside of covering portion 210, such as at or near outer perimeter 211. Upper portion 222 may be provided radially outwardly of channel 228. Channel 228 may include a channel outer wall 225, a channel bottom, 226, and/or a channel inner wall 227, which may be substantially U-shaped as shown to receive upper annular ring 213. The channel 228 may take another suitable form other than shown in the figures, such as V-shaped, for example.

Package 5 may include a dispensing portion 230, which may be provided with lid 20 as shown for example in FIG. 3. Dispensing portion 230 may include a panel 231, and entry slot 232, and/or a holding portion 233, any or all of which may be provided to facilitate dispensing a flexible sheet like material such as a wipe. For example, package 5, container 10, lid 20, and/or dispensing portion 230 may be configured to dispense healthcare wipes, sanitary wipes, cleaning wipes, and/or other wipes or similar materials. A wipe 181 (see FIGS. 4 and 5) may be caused to enter into holding portion 233 from a lid opening 219 via entry slot 232. Holding portion 233 may be configured to hold wipe 181 without active engagement from a user, for example, even after covering portion 210 has been moved into the closed position. Holding portion 233 may extend transverse to entry slot 232 to hold wipe 181, or for any other reason, and/or may take an X-shape, a cross shape, or other shape.

Figure 4:
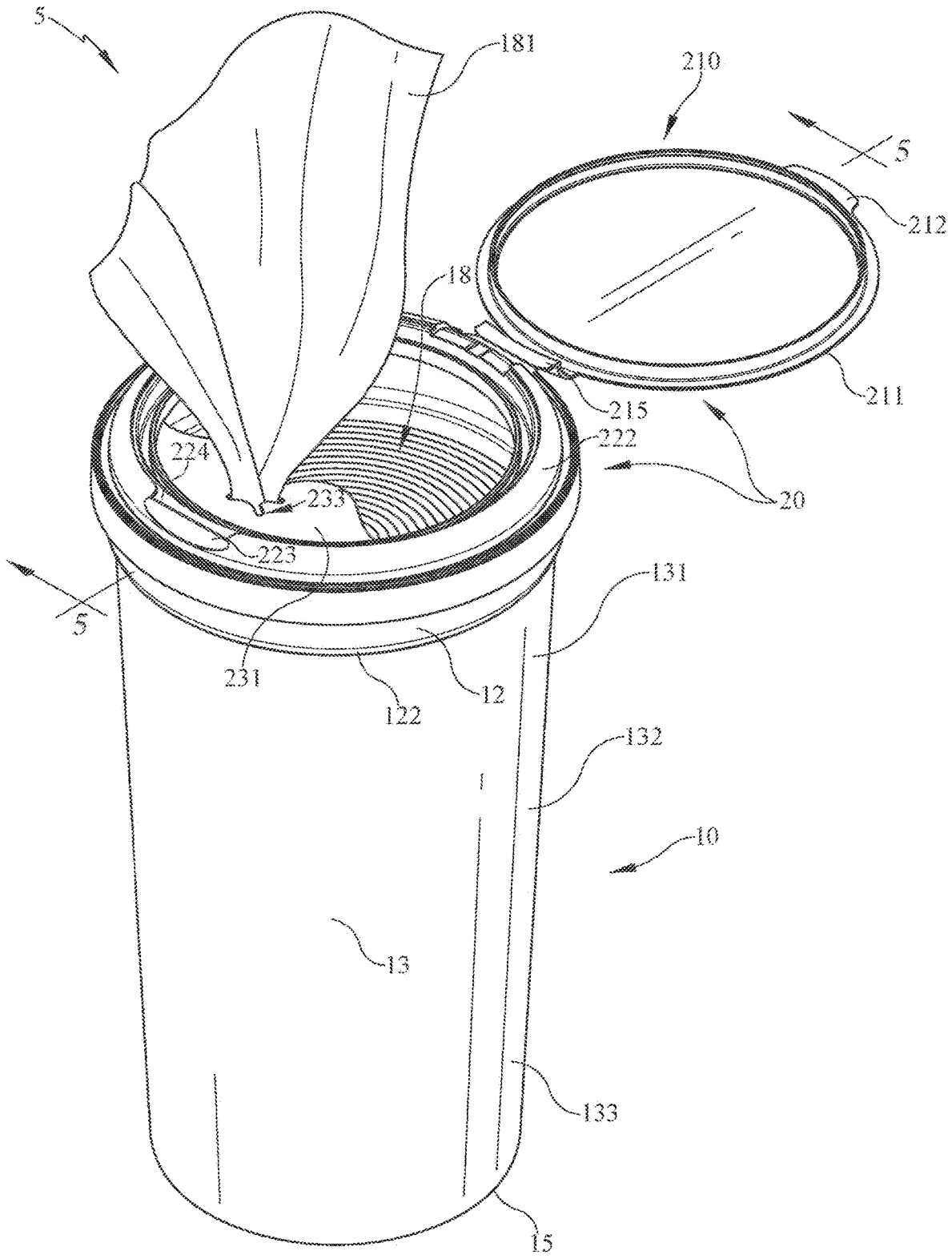
FIG. 4 is a perspective view of the open package of FIG. 3, shown with exemplary wipes being dispensed from the package and a wipe being held by a lid.
Figure 5:
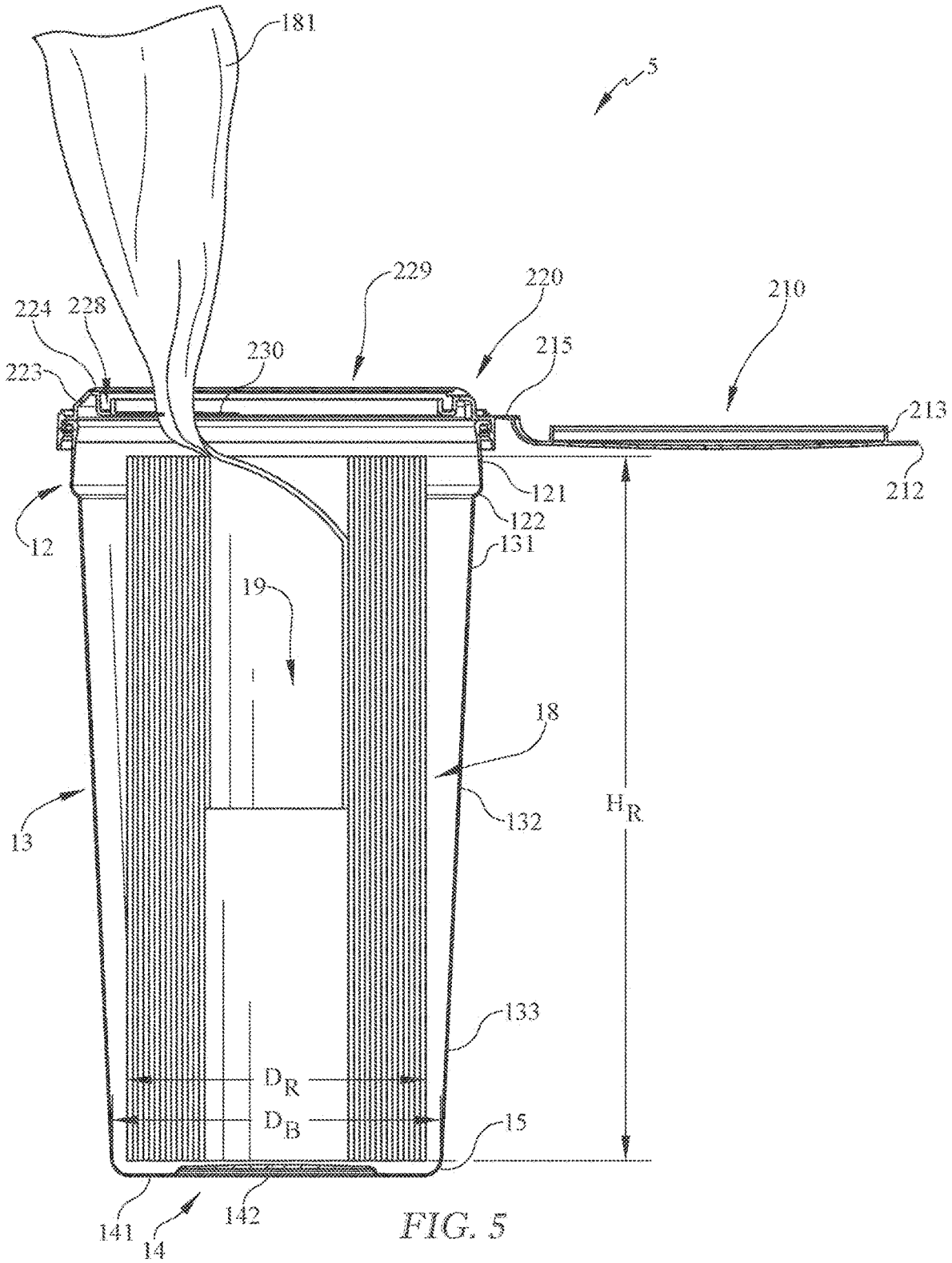
FIG. 5 is a sectional view taken along line 5-5 of FIG. 4.

As shown in FIGS. 4 and 5, this or other embodiments of package 5 and/or container 10 may be configured to hold contents, such as a wipe 181 or a plurality of wipes 18, within it. Container 10 may be substantially enclosed with one or more openings or apertures to allow access to product storage region 19, such as the opening defined by brim 11. The opening defined by brim 11 or otherwise may be configured to allow insertion and/or discharge of contents from container 10. Roll 18 may have a height $H_R$ and/or a diameter $D_R$. In some embodiments, for example if roll height $H_R$ is about 7", the height of container 10 from floor 14 to brim 11 may be about 8". In these or other embodiments, roll 18 may have roll diameter $D_R$ of about 3.375", for example, and/or container 10 may have a bottom diameter $D_B$ at or near where heel 14 meets side wall 13 of about 3.483". The height of container 10 may vary, for example, to accommodate a different roll height $H_R$. For example, container 10 may have a height of about 7" for a roll height $H_R$ of 6.25". Container 10 bottom diameter $D_B$ may vary to accommodate a different roll diameter $D_R$. For example, container 10 may have a bottom diameter $D_B$ of about 2.00" for a roll diameter $D_R$ of about 1.875".

Figure 6:
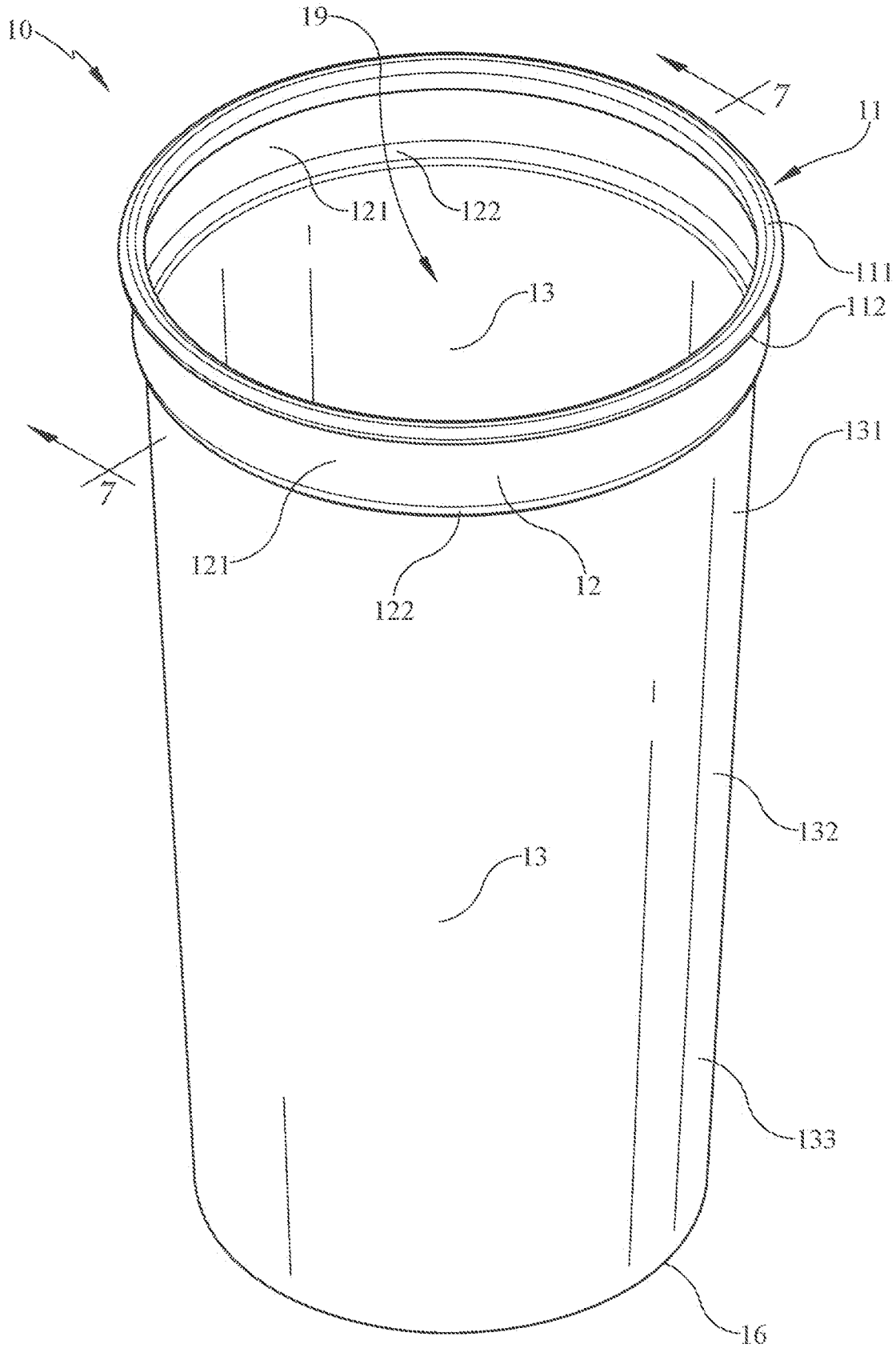
FIG. 6 is a perspective view of the container of FIG. 1.
Figure 7:
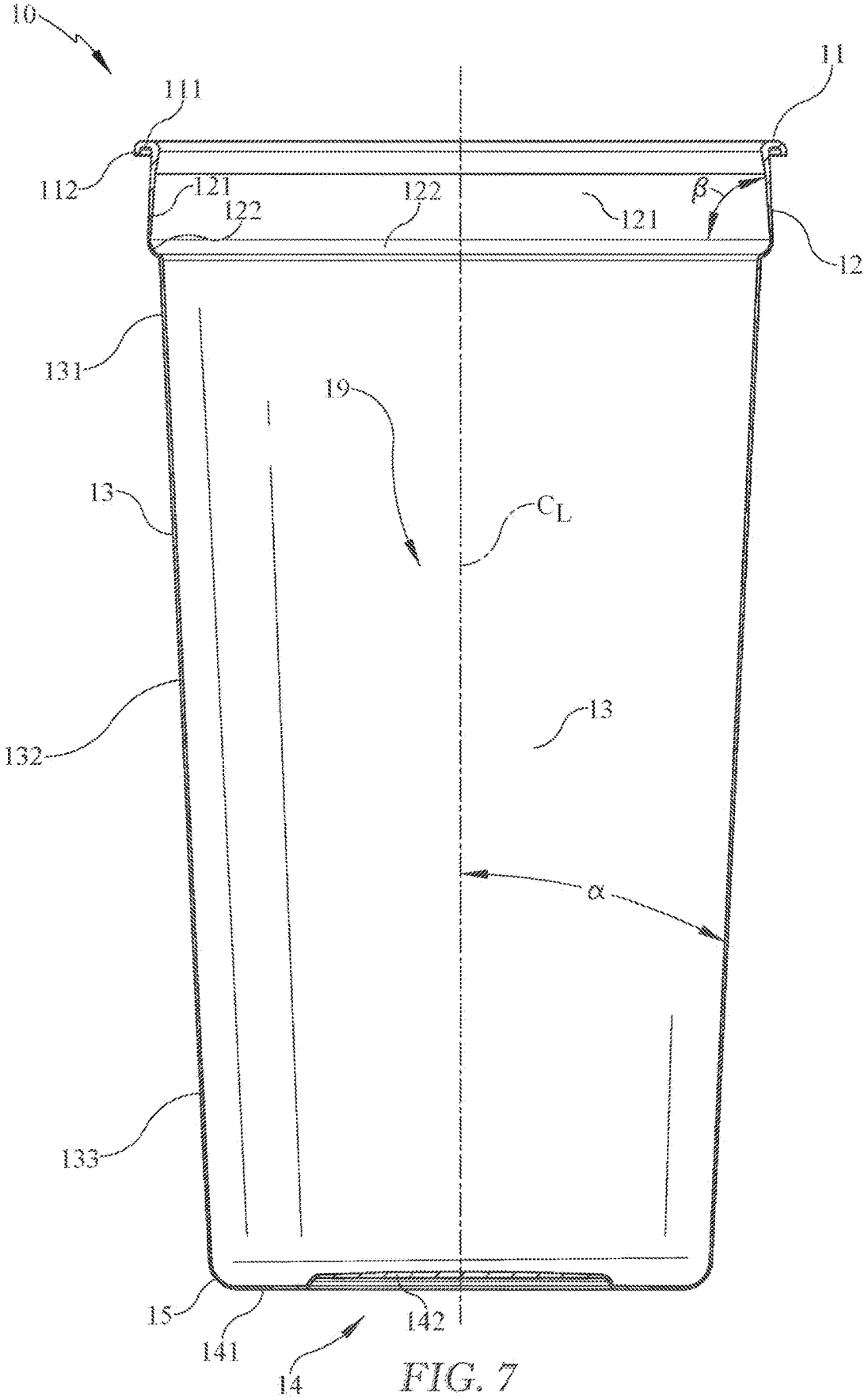
FIG. 7 is a sectional view taken along line 7-7 of FIG. 6.

Container 10 may be of any of a variety of shapes, including, but not limited to, the shape illustrated in FIGS. 6 and 7. In this embodiment, container 10 may be broadest at brim 11 and/or shoulder 12. Container 10 may be narrower at or near bottom 14. Container 10 may have a substantially frusto-conical shape and/or tapered side wall 13, as shown for example in FIGS. 6 and 7, with side wall 13 extending upwardly and outwardly from bottom 14 toward shoulder 12 at a first angle $\alpha$ relative to a center line $C_L$. If container 10 takes a conical shape, the widest dimension and/or diameter may be greater at or near brim 11 than it is at or near bottom 14. In some embodiments, first angle $\alpha$ may be about 2.80 degrees as shown for example in FIG. 7. First angle $\alpha$ may be in the range of about 1 degree to about 5 degrees, of about 2 degrees to about 4 degrees, in the range of about 2.5 degrees to about 3.5 degrees, and/or in the range of about 2.5 degrees to about 3 degrees.

As shown in FIG. 7, shoulder side wall 121 may extend upwardly and radially inwardly at a second angle $\beta$ from shoulder bottom 122 toward brim 11 and/or brim top surface 111. For example, at least a portion of brim 11 and/or brim top surface 111 may be disposed radially inwardly of at least portion of shoulder 12 and/or shoulder bottom 122 such that shoulder 12 of a first container 10 may rest on brim 11 of a second container disposed below the first container 10. In this way, for example, a plurality of containers 10 may be stacked together to form a first stack 31 as shown for example in FIG. 8. In some embodiments, second angle β may be about 87.75 degrees. Second angle β may be in the range of about 85 degrees to about 90 degrees, of about 86 degrees to about 89 degrees, in the range of about 87 degrees to about 88.5 degrees, and/or in the range of about 85.5 degrees to about 88 degrees. For first stack 31, of the overall height of container 10, more than about 50 percent of the height of an upper container 10 may be inside a lower container 10, more than about 60 percent of the height of an upper container 10 may be inside a lower container 10, more than about 70 percent of the height of an upper container 10 may be inside a lower container 10, more than about 80 percent of the height of an upper container 10 may be inside a lower container 10, and/or more than about 90 percent of the height of an upper container 10 may be inside a lower container 10.

Figure 8:
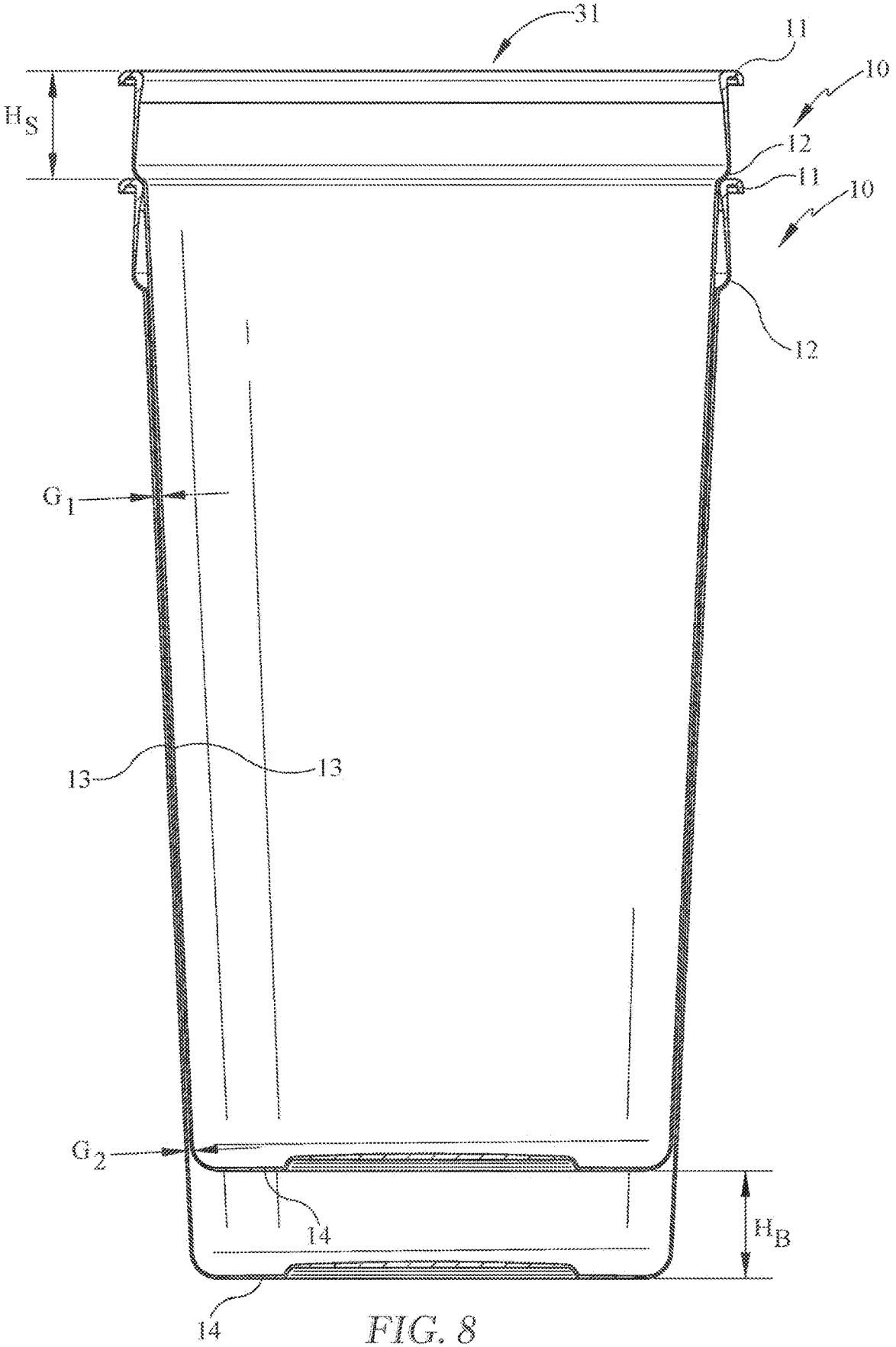
FIG. 8 is an elevation view showing a stack of two of the containers of FIG. 7.

As also shown in FIG. 8, brim 11 and/or shoulder 12 may be configured to allow or facilitate a capping or lidding operation, to facilitate stacking multiple containers together, to add structural rigidity to container 10, and/or for any other reason or combination of reasons. Structural rigidity might be enhanced, for example, to allow a closure or a lid such as lid 20 coupled to container 10 to be opened and closed repeatedly and/or to allow container 10 to carry a relatively high top load. Shoulder 12 may be sized, shaped, and/or configured to provide, for example, a nesting or stacking feature for stacking or nesting multiple containers together. Shoulder 12 may have a height, shape, and/or configuration, to provide an air gap between stacked containers 10 to facilitate denesting. For example, shoulder 12 may have a height $H_S$ of about 0.787 inches, which may provide a first air gap $G_1$ of about 0.015" at or near side wall upper area 131, central area 132, and/or lower area 133, and/or a second air gap $G_2$ of about 0.021" at or near heel 15. Air gap $G_2$ may be greater than and/or larger than air gap $G_1$ at least partially due to the inward extension and/or radius of curvature at heel 15.

In some embodiments, first air gap $G_1$ may be substantially similar and/or uniform along the height of side wall 13, taking into account manufacturing and/or thermoforming tolerances. First air gap G1 may be about 0.015" plus or minus 0.005" and/or in the range of about 0.010" to about 0.020". First air gap $G_1$ may vary based on geometry of container 10 and/or shoulder 12. For example, with a first angle β of about 2.80 degrees and a second angle β of about 87.75 degrees, shoulder height $H_S$ may be in the range of about 0.720" to about 0.900" to provide an air gap of about 0.010" to about 0.020". A height $H_B$ or distance between adjacent container bottoms 14 in stack 31 may be approximately equal to shoulder height $H_S$. It is understood that compression of container 10, for example when stacked, may cause $H_B$ to vary somewhat from $H_S$.

In one example, an 8" tall container 10 having a weight of about 34.5 grams may have a thickness of about 0.0243 inches at shoulder 12, about 0.0223 inches below shoulder 12 on side wall 13 about 1.150" from the top of container 10 and/or brim 11, about 0.0206 inches on side wall 13 about 2.350" from the top, about 0.0188 inches about 4" from the top, about 0.0161 inches about 5.900" from the top, about 0.0221 inches about 7.700" from the top (or about 0.300" from bottom 14), about 0.0150 inches at or near a corner or heel 15, about 0.0250" at a bottom flat area 141, and about 0.0634" at a bottom raised area 142. In this example, the thickest measurement on side wall 13 is about 0.0223" and the thinnest measurement on side wall 13 is about 0.0161", for a thickness difference or thickness delta of about 0.0062".

In another example, an 8" tall container 10 having a weight of about 35.5 grams may have a thickness of about 0.0260 inches at shoulder 12, about 0.0230 inches below shoulder 12 on side wall 13 about 1.150" from the top of container 10 and/or brim 11, about 0.0232 inches on side wall 13 about 2.350" from the top, 0.0214 inches about 4" from the top, about 0.0179 inches about 5.900" from the top, about 0.0201 about 7.700" from the top (or about 0.300" from bottom 14), about 0.0126 inches at or near heel 15, about 0.0202" at bottom flat area 141, and about 0.0530" at bottom raised area 142. In this example, the thickest measurement on side wall 13 is about 0.0232" and the thinnest measurement on side wall 13 is about 0.0179", for a thickness difference or thickness delta of about 0.0053".

In yet another example, an 8" tall container 10 having a weight of about 36.5 grams may have a thickness of about 0.0250 inches at shoulder 12, about 0.0195 inches below shoulder 12 on side wall 13 about 1.150" from the top of container 10 and/or brim 11, about 0.0195 inches on side wall 13 about 2.350" from the top, 0.0185 inches about 4" from the top, about 0.0181 inches about 5.900" from the top, about 0.0174 about 7.700" from the top (or about 0.300" from bottom 14), about 0.0265 inches at or near heel 15, about 0.0293" at bottom flat area 141, and about 0.0718" at bottom raised area 142. In this example, the thickest measurement on side wall 13 is about 0.0195" and the thinnest measurement on side wall 13 is about 0.0174", for a thickness difference or thickness delta of about 0.0021".

In the three examples above, the thicknesses and/or locations may vary within a reasonable tolerance. For example, the height may be measured plus or minus 0.020" and/or the thickness measurements may be plus or minus 0.020". In these or other embodiments, the thickness measurements may be plus or minus 0.010". In these or other embodiments, the thickness measurements may be plus or minus 0.005". Container 10 may have a weight in the range of about 30 to about 50 grams. For example, in the three examples above, container 10 may have a weight of about 34.5 grams, of about 35.5 grams, or of about 36.5 grams. In another embodiment, container 10 may have a weight of about 40 grams.

Figure 9:
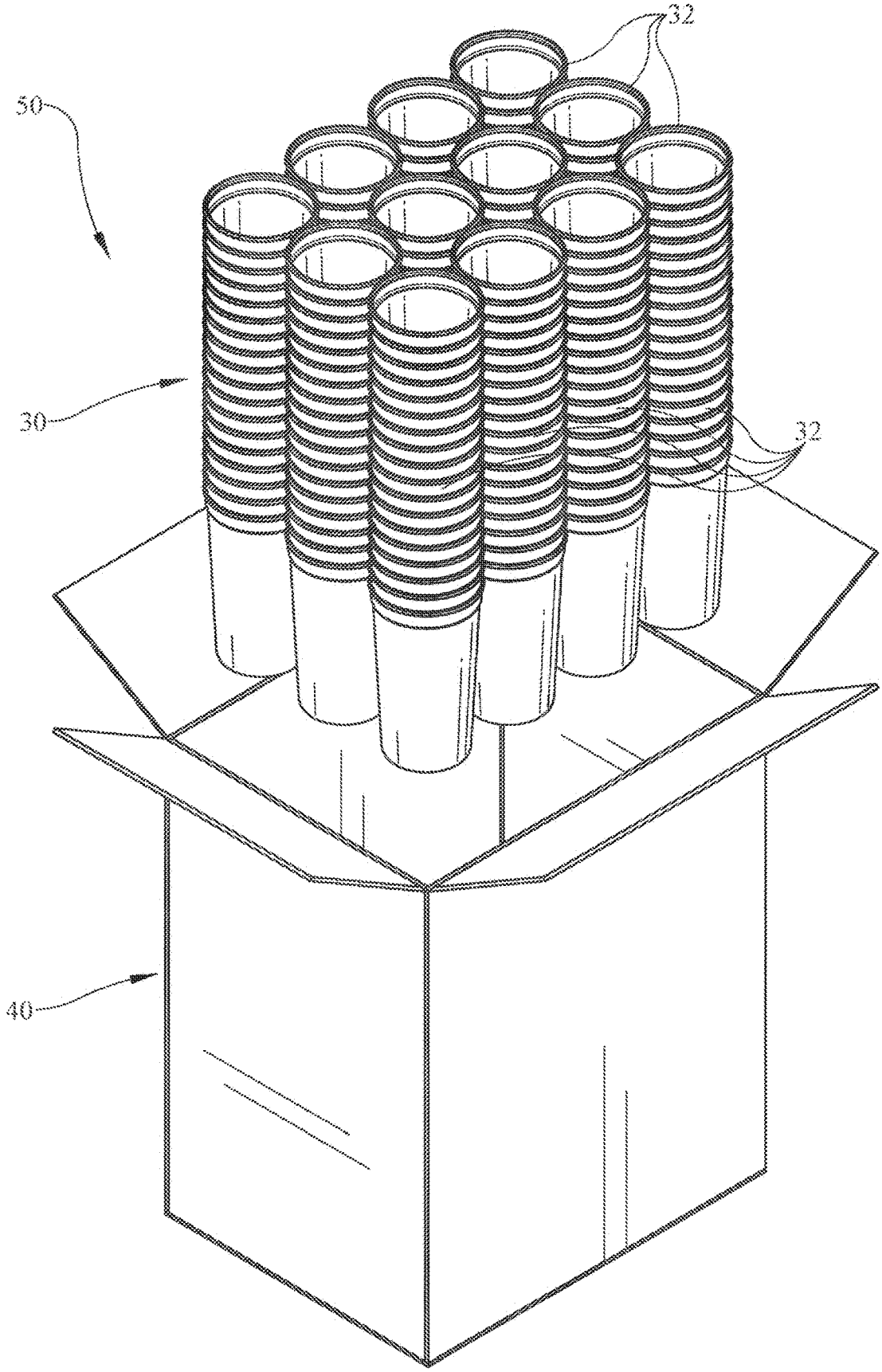
FIG. 9 is a perspective view showing an array of stacked containers as they might be arranged to be placed into a shipping carton.

FIG. 9 illustrates a shipping system 50 that may be employed to ship, transport, store, and/or deliver an array 30 of container stacks 32, with each container stack 32 including a plurality of containers 10. Virtually any number of containers 10 may be included in container stack 32. For example, container stack 32 may include 2 or more containers 10, 4 or more containers 10, 10 or more containers 10, and/or 20 or more containers 10. As shown in the example of FIG. 9, each stack 32 includes 18 containers. Array 30 may be configured to fit inside shipping container 40. For example, each stack 32 may include about 18 containers 10, and array 30 may include about 12 stacks 32 arranged in a 3×4 rectangle (i.e., three rows and four columns). In this way, for example, a relatively high number of relatively light weight and/or relatively rigid containers 10 may be shipped. Array 30 may vary in height, width, length, in number of container stacks 32 in any direction, or in virtually any other way. In one example, an individual shipping container 40 may be limited to a weight of about 35 pounds for ergonomic reasons or for any other reason or combination of reasons. For container 10 weighing about 35 grams, about 450 containers 10 can be placed in one 35 pound shipping container 40.

The example shipping system 50 shown in FIG. 9 shows a 3×4 array 30 of container stacks 32 each having 18 containers 10. For a 35 gram container 10, array 30 will weigh about 7,560 grams, or about 16.7 pounds. Shipping container 40 may be sized, shaped, and/or configured to fill out a 48"×40" skid or pallet as efficiently as possible. This may be accomplished, for example, with one or more layers of shipping containers arranged on the pallet. Any or all of the shipping containers 40 may include, contain, and/or have inserted into it, a 3×4 array 30 of container stacks 32, each container 10 in each container stack 32 having a top diameter, measured at brim 11, of about 2 inches to about 10 inches, of about 3 inches to about 8 inches, of about 4 inches to about 5 inches, and/or of about 4.5 inches to about 4.6 inches. For container stack 32, of the overall height of container 10, more than about 50 percent of the height of an upper container 10 may be inside a lower container 10, more than about 60 percent of the height of an upper container 10 may be inside a lower container 10, more than about 70 percent of the height of an upper container 10 may be inside a lower container 10, more than about 80 percent of the height of an upper container 10 may be inside a lower container 10, and/or more than about 90 percent of the height of an upper container 10 may be inside a lower container 10.

In use, a sheet of material having a thickness of about 0.160 inches to about 0.200 inches may be provided. The sheet of material may be thermoformed to a depth or container height in the range of about 4" to about 10", of about 6" to about 10", of about 4" to about 8", of about 6" to about 8" and/or to a height configured to be about 0.5 inches to about 2 inches, or about 1", greater than the height of a roll of wipes or other material to be placed in container 10. Container 10 may be thermoformed with first angle and/or second angle such that side wall 13 is wider at the top than at the bottom and shoulder 12 is narrower at the top than at the bottom. Containers 10 may be combined into an intermediary or first stack 31 and/or a container stack 32. A plurality of container stacks 32 may be provided in an array, such as in a rectangle, for example a 3×4 rectangular array 30. Array 30 may be provided in shipping container 40, which may be configured to be efficiently stacked in layers on a skid or pallet, such as a 48"×40" pallet.

One or more skids or pallets including shipping containers 40 and/or arrays 30 may be shipped or transported from a first location to a second location. For example, the first location may be a manufacturing facility and/or warehouse, and/or the second location may be a manufacturing facility, filling site, and/or warehouse that is different from the first location. Container 10 may be filled with contents such as a roll of wipes 18 and/or an impregnating solution for the roll of wipes 18 and/or each individual wipe 181 in roll of wipes 18. Container 10 may be closed with lid 20, which may include attachment portion 220 and/or covering portion 210. Lid 20 may be provided with hinge 215 to allow covering portion 210 to move between a closed position and an open position relative to attachment portion 220 and/or container 10. Package 5 may be provided with contents such as roll of wipes 18 contained within container 10 and/or lid 20. Packages 5 may be stacked one on top of another with a top load sufficient for the purpose of stacking a plurality of packages, for example, having a top load of at least about 100 lbs., or at least about 110 lbs., at least about 120 lbs, at least about 150 lbs., and/or at least about 170 lbs.

It is understood that any or all of container 10, brim 11, shoulder 12, side wall 13, bottom 14, and/or heel 15 may vary in shape and size from that shown in FIGS. 1 and 2. The shapes and sizes illustrated in FIGS. 1 and 2 are merely exemplary and not meant to limit the shapes, sizes, or orientations available for forming container 10.

An exemplary embodiment of container 10 may include dimensions shown in FIG. 2. As shown, container 10 may have a height of about 8.000" from top or brim 11 to bottom or floor 14, an inner top diameter of about 4.255" measured inside brim 11, an outer top diameter of about 4.535" measured outside brim 11, and/or a bottom diameter of about 3.483" measured at bottom 14. Bottom 14 may include bottom raised area 142, which may be concentric to and/or radially inside of bottom flat area 141, and bottom raised area 142 may have a diameter of about 2.182". Container 10 may have a longitudinal or vertical central axis C about which container 10 is disposed. Container 10 may include a draft angle of about 2.80 degrees of side wall 13 relative to central axis C. Any or all of these dimensions could vary considerably in other embodiments.

Side wall 13 may have a thickness or a variety of thicknesses. For example, in the first embodiment mentioned above having a weight of about 35 grams, side wall 13 may have a thickness in the range of about 0.010 inches to about 0.030 inches. Side wall upper area 131 may have a thickness of about 0.020 inches to about 0.024 inches, side wall intermediate area 132 may have a thickness of about 0.018 inches to about 0.022 inches, and/or side wall lower area 133 may have a thickness of about 0.018 inches to about 0.020 inches. Bottom flat area 141 may have a thickness of about 0.021 inches to about 0.025 inches and/or bottom raised area 142 may have a thickness of about 0.035 inches to about 0.049 inches.

To maximize top load and/or strength or rigidity of container 10 and/or package 5 while minimizing weight, or for any other reason, side wall 13 or any part thereof may have a substantially uniform thickness, subject to manufacturing tolerances. A substantially uniform thickness may reduce areas of minimum thickness, which may provide fail points from a top load perspective, and reduce the overall integrity of package 5 and/or container 10. For example, a thickness delta over side wall 13 may be the difference between the maximum thickness and minimum thickness. The thickness delta may be at most about 0.015", at most about 0.010", at most about 0.007", at most about 0.006", and/or at most about 0.005". For example, side wall 13 may have a thickness of about 0.015" to about 0.025", plus or minus about 0.005", a thickness in the range of about 0.010" to about 0.020", a thickness in the range of about 0.015" to about 0.025", a thickness in the range of about 0.020" to about 0.030". Side wall 13 may have a thickness of about 0.015 to about 0.25" plus or minus about 0.010", and/or a thickness in the range of about 0.010" to about 0.030". The thickness delta of side wall 13 may be in the range of about 0.005" to about 0.010". Container 10 may be thermoformed from a sheet of material. The sheet may have a gauge or thickness of about 0.180 inches plus or minus 0.020 inches.

The top load, as predicted theoretically by finite element analysis (FEA), may be about 173 lbs. with a side wall thickness of about 0.020", and about 278 lbs. with a side wall thickness of about. 0.025". In some embodiments, the side wall thickness may be such that the top load rating is about 159 lbs. plus or minus 50 lbs. For example, the top load may be at least about 100 lbs., or at least about 110 lbs., or at least about 120 lbs. The rigidity may be, for example, about 0.6 kgf plus or minus about 0.4 kgf.

An example of a process for testing or ascertaining rigidity on container 10 is provided herein. Gather parts for testing rigidity after all dimensional tests are complete. Set a force gauge to desired dimensions, such as kgf. Choose the correct plate for the size of container 10. Place the plate on a rigidity machine and use the machine to record the distance of deflection of container 10. The target travel distance may be about 0.250" for example. Once there has been 0.250" of travel, the required force will be measured. Ignition—Thermoforming may be used to record the test results, for example.

The variability of wall thickness may be achieved in any of a variety of ways, or combination thereof. For example, container 10 may be substantially formed of polypropylene that is thermoformed. In some embodiments, container 10 may be formed substantially of polypropylene, which may be substantially about 100% polypropylene. In some embodiments, the polypropylene used may be commercially available, such as, for example, BRASKEM 6023N. In these or other embodiments, FORMOLENE HB5502B may be used instead of or in addition to BRASKEM 6023N. In another example, container 10 may be substantially formed of HDPE that is thermoformed.

The container 10, or any component thereof, may take the form of a cylinder or cone with varying diameter, such as is shown in FIGS. 1 and 2. However, the container 10 may take any of a variety of suitable shapes and/or diameters and/or dimensions, virtually without limitation. For example, container 10 or any portion thereof, such as sidewall 13 or bottom 14 for example, may take the form of an extending square or rectangle, triangle, polygon, oval, sphere, half-sphere, free form, or any other shape or any combination thereof. Moreover, a different portion of container 10 may be of different shapes than any or all other portions of container 10. Any of a variety of suitable shapes and combinations thereof may be used to form container 10 or any component thereof.

A portion of container 10, brim 11, and/or shoulder 12 may be configured to receive, fasten, attach, and/or couple to a closure, such as the container closure discussed above (not shown). Exemplary mechanisms to couple a container closure to container 10 that may be used is a threaded screw on closure, or a snap or friction fit closure. Container closure and/or another type of closure may be provided with one or more tamper evident features, child resistant features, sealing features, and/or other types of features or any combinations thereof.

The container 10 and/or any component thereof may be made of any of a variety of materials, including, but not limited to, any of a variety of suitable plastics material, any other material, or any combination thereof. Suitable plastics material may include, but is not limited to, polyethylene terephthalate (PET), polyethylene (PE), polypropylene (PP), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. Multiple layers of material may be used for any of a variety of reasons, including to improve barrier properties, or to provide suitable functions related to multiple layer structures. The multiple layers, if included, may be of various materials, including but not limited to those recited herein.

The container 10 or any component thereof may be substantially rigid, substantially flexible, a hybrid of rigid and flexible, or any combination of rigid, flexible, and/or hybrid, such as having some areas be flexible and some rigid. These examples are merely illustrative, are not limiting, and are provided to illustrate the versatility of options available in various embodiments of container 10.

Any of a variety of suitable processes or combination thereof may be used to form container 10, any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. In some embodiments, container 10 and/or any component thereof may be formed substantially of thermoformed PP, although other materials and forming processes may be used instead of or in addition to PP and thermoforming, respectively. Various materials and/or processes may be used to form container 10 and/or any component thereof as will be understood by one of ordinary skill in the art. In some embodiments, container 10 may be substantially a one-piece design and/or substantially formed as an integral or unitary structure.

It may be desirable to provide a container that can be used to hold contents such as a liquid. For example, it may be desirable to provide a container that can store contents such as sanitary or healthcare wipes. Such a container may be configured to receive a closure as well.

A variety of materials may be employed to provide containers. For example, containers may be made of a variety of plastic materials. Such materials may be used, at least in part, because they securely contain contents and keep them fresh while also providing sufficient structural rigidity and integrity to survive filling, bottling, distributing, shipping, and other operations.

The invention claimed is:

1. A shipping system for shipping a plurality of stackable containers, comprising:

a pallet;

a plurality of shipping containers stacked on the pallet;

each shipping container of the plurality of shipping containers containing a rectangular array of container stacks;

each container stack including at least two containers stacked together;

wherein each container stack includes at least one upper container having a height that is inserted at least 50 percent into a lower container;

wherein each container has a tapered side wall that is wider at the top than at the bottom;

wherein each container includes a shoulder that is tapered radially inwardly as it extends from a shoulder bottom to a brim to provide a stacking shoulder having a shoulder height that is not inserted into a lower container when in the container stack;

wherein each container has a weight of 37 grams or less; and wherein each container has a top load rating of at least 100 lbs.

2. The shipping system of claim 1, wherein the rectangular array of container stacks includes three rows and four columns.

3. The shipping system of claim 2, wherein each container has a top end diameter within a range of about 3 inches to about 8 inches.

4. The shipping system of claim 2, wherein each container stack includes at least 18 containers.

5. The shipping system of claim 4, wherein each container has a height within a range of about 4 inches to about 10 inches.

6. The shipping system of claim 5, wherein the height is about 8 inches.

7. The shipping system of claim 6, wherein the at least one upper container is inserted at least 80 percent into the lower container.

8. The shipping system of claim 3, wherein the top diameter is about 4.5 inches.

9. The shipping system of claim 8, wherein the pallet is 48 inches by 40 inches and the plurality of shipping containers fill out the pallet.

10. The shipping system of claim 1, wherein each shipping container contains about 450 containers and each shipping container does not exceed 35 lbs when filled with the containers.

11. The shipping system of claim 1, wherein the plurality of shipping containers includes a plurality of stacked layers.

12. The shipping system of claim 1, wherein the shipping containers fill out the pallet.

13. A shipping system for shipping a plurality of stackable containers, comprising:

a pallet;

a plurality of shipping containers resting on the pallet;

each shipping container of the plurality of shipping containers containing an array of container stacks;

each container stack including at least two containers stacked together;

wherein each container stack includes at least one upper container having a height that is inserted at least 50 percent into a lower container;

wherein each container has a tapered side wall that is wider at the top than at the bottom;

wherein each container includes a shoulder that is tapered radially inwardly as it extends from a shoulder bottom to a brim to provide a stacking shoulder having a shoulder height that is not inserted into a lower container when in the container stack, and wherein the shipping containers fill out the pallet.

14. The shipping system of claim 13, wherein the array of container stacks includes three rows and four columns.

15. The shipping system of claim 14, wherein each container has a top end diameter within a range of about 3 inches to about 8 inches.

16. The shipping system of claim 15, wherein the top diameter is about 4.5 inches.

17. The shipping system of claim 16, wherein the pallet is 48 inches by 40 inches.

18. The shipping system of claim 13, wherein each shipping container contains about 450 containers and each shipping container does not exceed 35 lbs when filled with the containers.

19. The shipping system of claim 18, wherein the plurality of shipping containers includes a plurality of stacked layers and each container has a top load of at least 100 lbs.

* * * * *